US008591290B2

(12) United States Patent
Liwszyc et al.

(10) Patent No.: US 8,591,290 B2
(45) Date of Patent: Nov. 26, 2013

(54) CUTTING HEAD AND CUTTING NOZZLE FOR A LIQUID/ABRASIVE JET CUTTING ARRANGEMENT

(75) Inventors: Danek Liwszyc, Canning Vale (AU); Adam Liwszyc, Canning Vale (AU); Joshua A. Liwszyc, Canning Vale (AU)

(73) Assignee: Abrasive Cutting Technology Ltd., Dublin (IE)

( * ) Notice: Subject to any disclaimer, the term of this patent is extended or adjusted under 35 U.S.C. 154(b) by 698 days.

(21) Appl. No.: 12/674,265

(22) PCT Filed: Aug. 21, 2008

(86) PCT No.: PCT/AU2008/001228

§ 371 (c)(1),
(2), (4) Date: Feb. 19, 2010

(87) PCT Pub. No.: WO2009/023929

PCT Pub. Date: Feb. 26, 2009

(65) Prior Publication Data

US 2011/0195641 A1 Aug. 11, 2011

(30) Foreign Application Priority Data

Aug. 21, 2007 (AU) ..... 2007904498
Aug. 21, 2007 (AU) ..... 2007904499
Aug. 21, 2007 (AU) ..... 2007904500

(51) Int. Cl.
*B24C 5/00* (2006.01)

(52) U.S. Cl.
USPC ..... 451/102

(58) Field of Classification Search
USPC ..... 451/102
See application file for complete search history.

(56) References Cited

U.S. PATENT DOCUMENTS

| | | | | |
|---|---|---|---|---|
| 4,555,872 | A * | 12/1985 | Yie | 451/40 |
| 4,707,952 | A * | 11/1987 | Krasnoff | 451/75 |
| 5,018,317 | A * | 5/1991 | Kiyoshige et al. | 451/102 |
| 5,155,946 | A * | 10/1992 | Domann | 451/75 |
| 6,425,805 | B1 * | 7/2002 | Massa et al. | 451/40 |
| 2003/0027100 | A1 * | 2/2003 | Grant | 433/88 |

FOREIGN PATENT DOCUMENTS

| | | | |
|---|---|---|---|
| DE | 10348805 | A1 | 6/2005 |
| JP | 2007130716 | A | 5/2007 |
| WO | 91/01852 | A1 | 2/1991 |
| WO | 97/07378 | A2 | 2/1997 |

(Continued)

OTHER PUBLICATIONS

International Search Report for PCT/AU2008/001228, dated Oct. 16, 2008.

(Continued)

*Primary Examiner* — Maurina Rachuba
(74) *Attorney, Agent, or Firm* — Bachman & LaPointe, P.C.

(57) ABSTRACT

A nozzle for a high pressure cutting arrangement is disclosed. The cutting arrangement comprises a liquid stream and a slurry stream, the slurry comprising abrasive particles suspended in a fluid, with both fluids being supplied into the nozzle under pressure. The nozzle has a combining chamber, having an entry region arranged to receive the liquid stream and the slurry stream, such that the pressure in the entry region is determined by the pressure in the liquid stream. The pressure in the entry region acts on the pressure in the slurry stream to regulate the pressure in the slurry stream.

21 Claims, 8 Drawing Sheets

(56) References Cited

FOREIGN PATENT DOCUMENTS

| | | | |
|---|---|---|---|
| WO | 97/40963 | A1 | 11/1997 |
| WO | 2007/052027 | A1 | 5/2007 |
| WO | 2009/023927 | A1 | 2/2009 |
| WO | 2009/023928 | A1 | 2/2009 |

OTHER PUBLICATIONS

U.S. Appl. No. 12/674,263 (attached as WO2009/023928).
U.S. Appl. No. 12/674,261 (attached as WO2009/023927).

* cited by examiner

CUTTING HEAD AND CUTTING NOZZLE FOR A LIQUID/ABRASIVE JET CUTTING ARRANGEMENT

CROSS-REFERENCE TO RELATED APPLICATION

This application is a 371 application of International Patent Application PCT/AU2008/001228, filed Aug. 21, 2008, which claims priority of Australian Patent Application Ser. No. 2007904499, filed Aug. 21, 2007, Australian Patent Application Ser. No. 2007904498, filed Aug. 21, 2007, and Australian Patent Application Ser. No. 2007904500, filed Aug. 21, 2007.

FIELD OF THE INVENTION

The present invention relates to cutting (for instance of metals) by jets of liquid including entrained abrasive particles.

BACKGROUND TO THE INVENTION

The use of high velocity water jets containing entrained abrasive particles for cutting purposes has been known since about 1980. Known cutting water jet systems fall into one of two categories: Abrasive water jet (AWJ) systems and Abrasive suspension jet (ASJ) systems.

AWJ systems typically supply water at extremely high pressure (in the order of 150 to 600 MPa) to a nozzle. A typical AWJ nozzle 10 is shown in FIG. 1. The nozzle 10 includes a small orifice 12 (0.2 to 0.4 mm diameter) which leads into a mixing chamber 14. Water thus flows through the mixing chamber 14 at a high velocity.

Small grains of abrasive material, typically garnet, are supplied to the chamber, generally by a gravity feed through a hopper 16. The high water velocity 18 creates a venturi effect, and the abrasive material is drawn into the water jet.

The water jet then flows through a length of tubing known as a focusing tube 20. The passage of water and abrasive through the focussing tube acts to accelerate the abrasive particles in the direction of water flow. The focussed water jet 22 then exits through an outlet 24 of the focussing tube. The water jet 22—or, more accurately, the accelerated abrasive particles—can then be used to cut materials such as metal.

The energy losses in the nozzle 10 between the orifice 12 and the outlet 24 of the focussing tube 20 can be high. Kinetic energy of the water is lost by the need to accelerate the abrasive material, and also to accelerate air entrained by the venturi. Significant frictional losses occur in the focussing tube 20, as abrasive particles 'bounce' against the walls of the tube. This results in energy loss due to heat generation. As an aside, this phenomenon also results in degradation of the focussing tube, which typically needs replacing after about 40 hours' operation.

Known AWJ systems are therefore highly inefficient.

ASJ systems combine two fluid streams, a liquid (generally water) stream and a slurry stream. The slurry contains a suspension of abrasive particles. Both liquid streams are placed under a pressure of about 50 to 100 MPa, and are combined to form a single stream. The combined stream is forced through an orifice, typically in the order of 1.0 to 2.0 mm diameter, to produce a water jet with entrained abrasive particles.

ASJ systems do not suffer from the same inefficiencies as AWJ systems, as there is no energy loss entailed in combining the two pressurised streams. Nonetheless, known ASJ systems are of limited commercial value. This is partly because ASJ systems operate at significantly lower pressures and jet velocities than AWJ systems, limiting their ability to cut some materials.

ASJ systems also evidence significant difficulties in operation, primarily due to the presence of a pressurised abrasive slurry, and to the lack of effective means to provide control over its flow characteristics. The parts of the system involved in pumping, transporting and controlling the flow of the abrasive slurry are subject to extremely high wear rates. These wear rates increase as the pressure rises, limiting the pressure at which ASJ systems can safely operate.

Of possible greater significance are the practical difficulties inherent in starting and stopping a pressurised abrasive flow. When used for machining, for instance, a cutting water jet must be able to frequently start and stop on demand. For an ASJ system, this would require the closing of a valve against the pressurised abrasive flow. Wear rates for a valve used in such a manner are extremely high. It will be appreciated that during closing of a valve the cross-sectional area of flow decreases to zero. This decreasing of flow area causes a corresponding increase in flow velocity during closing of the valve, and therefore increases the local wear at the valve.

In a typical industrial CNC environment, cutting apparatus can be required to start and stop extremely frequently. This translates to frequent opening and closing of valves against pressurised abrasive flow, and rapid wear and deterioration of these valves. As a result, the use of ASJ systems for CNC machining is known to be inherently impractical.

ASJ systems have found use in on-site environments, such as oil-and-gas installations and sub-sea cutting, where the cutting required is largely continuous. ASJ systems have not been commercially used in industrial CNC machining.

FIGS. 2*a* and 2*b* show schematic representations of known ASJ systems. In a basic single stream system 30, as shown in FIG. 2*a*, a high pressure water pump 32 propels a floating piston 34. The piston 34 pressurises an abrasive slurry 36 and pumps it into a cutting nozzle 38.

A simple dual-stream system 40 is shown in FIG. 2*b*. Water from the pump 32 is divided into two streams, one of which is used to pressurise and pump a slurry 36 by means of a floating piston 34 in a similar manner to the single stream system 30. The other stream, a dedicated water stream 35, is combined with a pressurised slurry stream 37 at a junction prior to the cutting nozzle 38.

Both of these systems suffer from the problems outlined above, and result in very high valve wear rates. Other problems include an inconsistent cutting rate due to extreme wear in the tubes and nozzle.

An alternative arrangement is proposed in U.S. Pat. No. 4,707,952 to Krasnoff. A schematic arrangement of the Krasnoff system 50 is shown in FIG. 3*a*. The Krasnoff system is similar to the dual-stream system 40, with the difference being that mixing of the water stream 35 and slurry stream 37 takes place in a mixing chamber 52 within the cutting nozzle 38.

A more detailed view of the mixing chamber 52 of Krasnoff is shown in FIG. 3*b*. The nozzle 38 provides a two-stage acceleration. Firstly, the water stream 35 and the slurry stream 37 are accelerated through independent nozzles leading into the mixing chamber 52. Then the combined water and abrasive stream is accelerated through the final outlet 54.

The Krasnoff system is arranged to operate at a pressure of about 16 MPa, significantly lower than other ASJ systems. As such, the impact of the slurry stream 37, whilst still damaging to valves, results in reduced valve wear rates than in higher pressure systems. The corollary is, of course, that the power output of the Krasnoff system is even lower than other ASJ systems, and thus its commercial applications are small. The applicant is not aware that the Krasnoff system has ever been commercially applied.

The present invention seeks to provide a system for creating a high pressure water jet with entrained abrasive particles which overcomes, at least in part, some of the above mentioned disadvantages of above AWJ and ASJ systems.

SUMMARY OF THE INVENTION

In essence, the present invention proposes a method which combines many of the advantages of AWJ and ASJ systems whilst reducing some of the disadvantages of each system.

In accordance with a first aspect of the present invention there is provided a cutting tool for a high pressure cutting arrangement, the cutting arrangement comprising a liquid stream and a slurry stream, the slurry comprising abrasive particles suspended in a fluid, the cutting tool including a combining chamber, the combining chamber having an entry region arranged to receive the liquid stream and the slurry stream, wherein the pressure in the entry region is determined by the pressure in the liquid stream, and the pressure in the entry region acts on the pressure in the slurry stream to regulate the pressure in the slurry stream.

Preferably the slurry stream and the liquid stream are arranged to enter a nozzle, the nozzle being elongate and the slurry stream and the fluid stream being oriented in the elongate direction. This reduces energy loss associated with changing flow direction, particularly of the slurry.

The cutting tool may include a housing within which the nozzle is supported. The housing may include a outlet for the combined stream, the outlet having an exit chamfer with a cone angle of about 45°.

Preferably the cutting tool includes a slurry valve which can selectively permit or prevent the flow of slurry into the nozzle and a liquid valve which can selectively permit or prevent the flow of liquid into the nozzle.

Preferably the position of the slurry stream relative to the combining chamber is adjustable.

In accordance with a second aspect of the present invention there is provided a nozzle for a high pressure cutting arrangement, the cutting arrangement comprising a liquid stream and a slurry stream, the slurry comprising abrasive particles suspended in a fluid, the nozzle including a combining chamber, the combining chamber having an entry region arranged to receive the liquid stream and the slurry stream, wherein the pressure in the entry region is determined by the pressure in the liquid stream, and the pressure in the entry region acts on the pressure in the slurry stream to regulate the pressure in the slurry stream.

Preferably the nozzle is elongate, and the slurry stream and the liquid stream are oriented in the elongate direction.

In a preferred arrangement the nozzle has a central axis, with the slurry stream being oriented along the central axis and the liquid stream being provided in an anulus about the slurry stream. Such an arrangement provides an efficient means of exposing the slurry stream to the pressure of the liquid stream, and also reduces the propensity for the sides of the nozzle to wear.

Preferably the nozzle is an accelerating nozzle, with an outlet smaller in diameter than the entry region. This allows the pressure within the streams to be converted to a high velocity output stream.

The effect is further enhanced by making an outlet smaller in diameter than a diameter of the slurry stream on entry into the nozzle.

Preferably the nozzle has a constant diameter focussing portion at an outer end thereof, and a conical accelerating portion of reducing diameter between the entry region and the focussing portion. This allows the output stream to achieve both a desired velocity and direction.

The cone angle of the accelerating portion should not exceed 27°. Preferably, the cone angle should be about 13.5°. This provides a good balance between efficient acceleration and maintaining non-turbulent flow.

Preferably, the focussing portion of the nozzle should have a length:diameter ratio greater than 5:1, preferably about 10:1. It is also preferred that the length:diameter ratio is less than about 30:1.

Preferably, the nozzle is a two-part nozzle, with the combining chamber defining a first part and the focussing portion contained within a second part.

Preferably the second part is a focussing nozzle, and includes an accelerating portion with cone angle greater than or equal to that of the combining chamber. The second part may be a compound nozzle, with the accelerating portion formed from a material harder than that of the focussing portion.

The focussing portion may have a diameter equal to or slightly smaller than the smallest diameter of the accelerating region, to guard against the introduction of turbulence.

Preferably the accelerating portion of the focussing nozzle is constructed from an abrasive resistant material such as diamond.

The focussing nozzle may have an outlet including an exit chamfer having a cone angle of about 45°. Such an angle is sufficient to ensure flow separation at the outlet.

In accordance with a third aspect of the present invention there is provided a focussing nozzle for a high pressure cutting arrangement arranged to receive a liquid stream and a slurry stream, wherein the focussing nozzle has a constant diameter focussing portion at an outer end thereof, and a conical accelerating portion of reducing diameter between an entry region and the focussing portion.

Preferably, the cone angle should not exceed 27°, and may be about 13.5°.

Preferably, the focussing portion of the nozzle should have a length:diameter ratio greater than 5:1, or even 10:1.

Preferably, the focussing nozzle should be of a diamond material.

In accordance with a fourth aspect of the present invention there is provided a nozzle for a high pressure cutting arrangement, the cutting arrangement comprising a liquid stream and a slurry stream, the slurry comprising abrasive particles suspended in a fluid, the nozzle including a combining chamber and a focussing portion, wherein the combining chamber is made from a first material and the focussing portion is made from a second material.

Preferably the focussing portion is part of a focussing nozzle formed from the second material, the focussing nozzle including an accelerating region adjacent, in use, the combining chamber.

In a preferred embodiment the cutting tool and nozzle are used in conjunction with a high pressure cutting arrangement comprising a liquid stream and a slurry stream, the slurry comprising abrasive particles suspended in a fluid, energy being supplied to the liquid stream by a first energising means and energy being supplied to the slurry stream by a second energising means, each of the first and the second energising means being selectively operable, wherein the liquid stream and the slurry stream are combined in the cutting tool, at least a portion of the supplied energy being converted to kinetic energy in the cutting tool to produce a combined liquid and abrasive stream at high velocity. The use of separate energising means allows control over stream flows in the system.

Preferably the energy supplied by the first energising means is provided by a pump, most preferably a constant pressure pump, which pressurises the liquid stream. Similarly, the energy supplied by the second energising means is preferably provided by a pump, most preferably a constant flow pump. This arrangement allows the velocity and volume rate of the combined stream to be regulated by control of the pressure of the constant pressure pump, whilst the flow rate of abrasive material can be independently set by controlling the flow rate of the constant flow pump. Adjustment of the system power, or the liquid:abrasive ratio, can thus be readily achieved. In an alternative arrangement, a single pump may provide energy to both the first and the second energising means.

In a preferred embodiment, the constant flow pump energises a piston, which in turn pressurizes the slurry stream. In this embodiment a valve may be provided between the pump and the piston, such that the flow of fluid and therefore energy from the constant flow pump to the piston can be instantly prevented. Conveniently, this valve may also act to prevent back flow of fluid from the piston. In this way pressure and flow in the slurry stream can be allowed to vary whilst maintaining constant pressure in the liquid stream. The valve may simply act to divert the constant fluid flow away from the piston, for instance by returning the fluid to a reservoir of the pump.

In its preferred form the cutting tool allows the streams to combine in such a way that the pressure of the slurry stream is governed primarily by the pressure of the liquid stream. The cutting tool includes a combining chamber into which the liquid stream, when energised, is provided at a substantially constant pressure; and the slurry stream, when energised, is provided at a substantially constant rate. The pressure at an entry region of the combining chamber is thus set by the pressure of the liquid stream. The point of entry of the slurry stream into the combining chamber is exposed to this pressure, in such a way that the slurry stream is prevented from entering the combining chamber unless the pressure in the slurry stream is marginally higher than the pressure at the combining chamber entry point. The action of the constant volume pump builds the pressure in the slurry stream until it reaches this point. A first equilibrium condition is then achieved where slurry is provided at a constant flow rate, and at the required pressure, into the combining chamber. Under these conditions the constant volume pump effectively acts as a constant displacement delivery pump.

When the second energising means ceases providing energy to the slurry stream, for instance by closing of the valve between pump and piston in the preferred embodiment, the pressure of the liquid stream in the combining chamber continues to act on the slurry stream. Slurry from the slurry stream continues to enter the combining chamber until such time as the pressure in the slurry stream drops marginally below the pressure in the combining chamber. At this point, the flow of slurry ceases but the pressure in the slurry stream is maintained.

It will be appreciated that the ceasing of energy supply from the second energising means results in an almost instantaneous ceasing of slurry, due to the small pressure difference in the slurry between a flowing state and a static state. Similarly, when the second energising means is activated, the required flow of slurry into the combining chamber is achieved almost instantaneously.

BRIEF DESCRIPTION OF THE DRAWINGS

It will be convenient to further describe the invention with reference to the accompanying drawings which illustrate preferred embodiments of the high pressure cutting arrangement of the present invention. Other embodiments are possible, and consequently, the particularity of the accompanying drawings is not to be understood as superseding the generality of the preceding description of the invention. In the drawings.

DESCRIPTION OF PREFERRED EMBODIMENT

Figure 1:
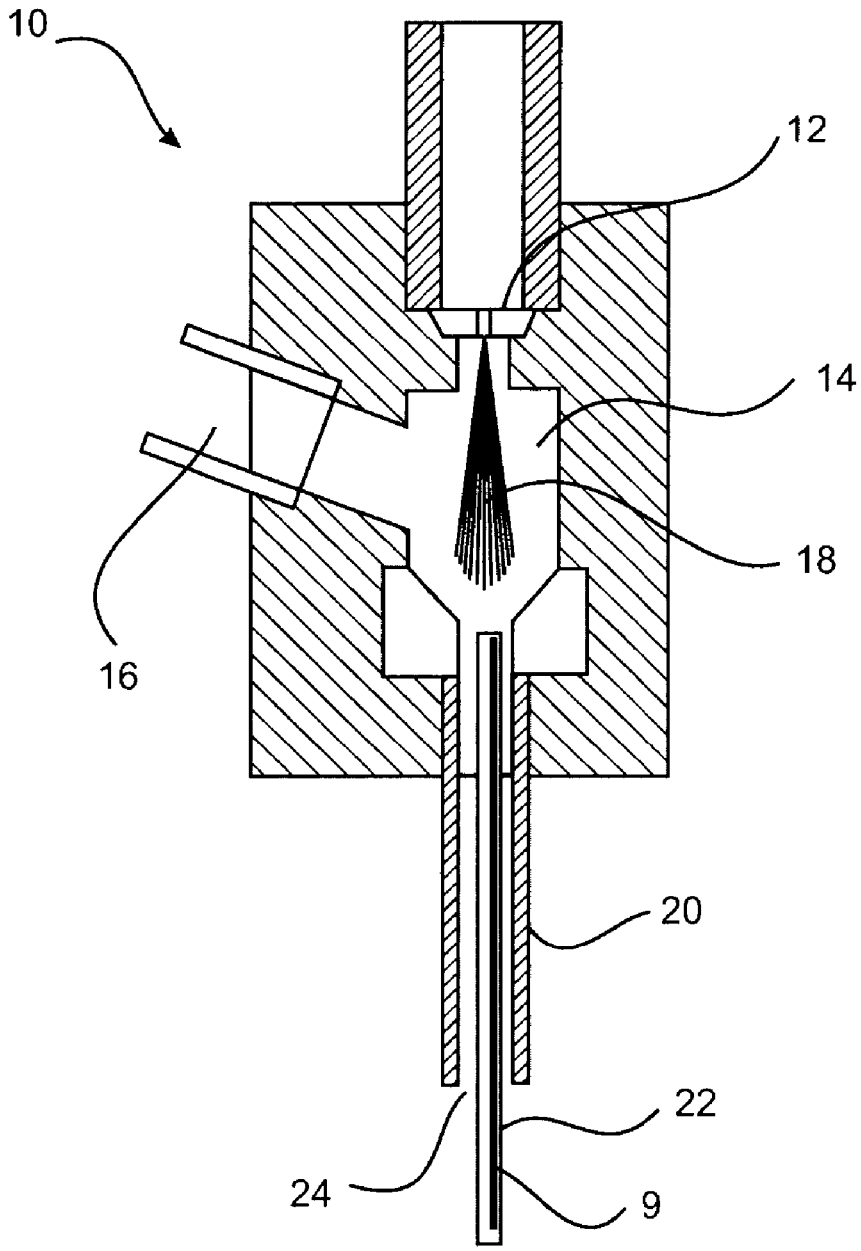
Fig 1 Prior Art
FIG. 1 is a schematic cross sectional view of a cutting tool of an AWJ system of the prior art.
Figure 2A:
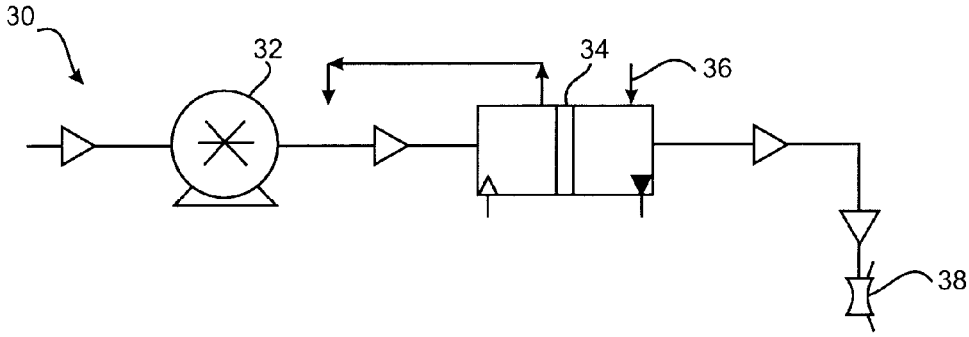
Fig 2a Prior Art
FIG. 2*a* is a schematic view of a single fluid ASJ system of the prior art.
Figure 2B:
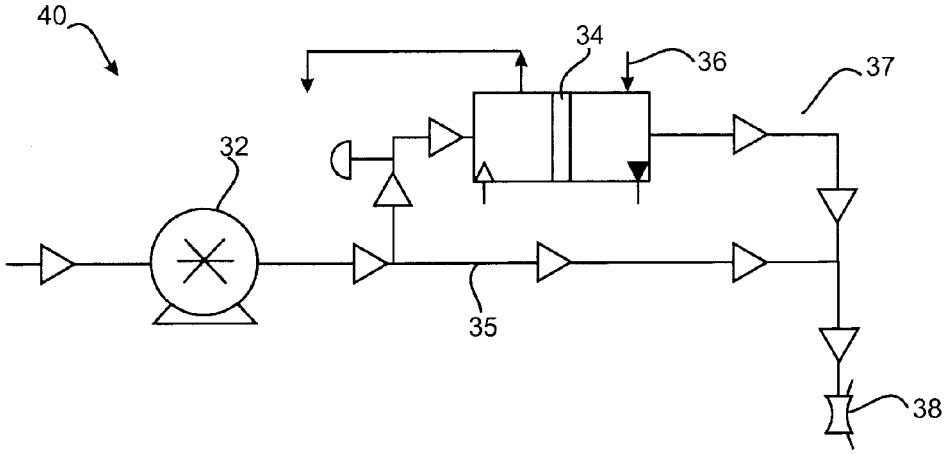
Fig 2b Prior Art
FIG. 2*b* is a schematic view of a dual fluid ASJ system of the prior art.
Figure 3A:
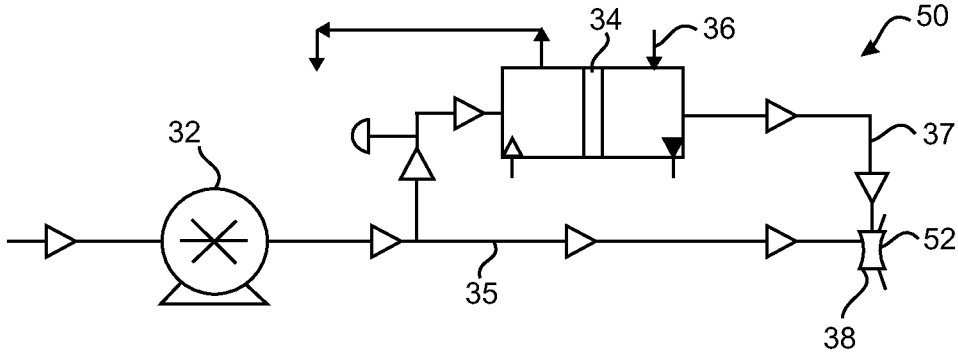
Fig. 3a Prior Art
FIG. 3*a* is a schematic view of a dual fluid ASJ system of the prior art where fluids are injected into a cutting nozzle.
Figure 3B:
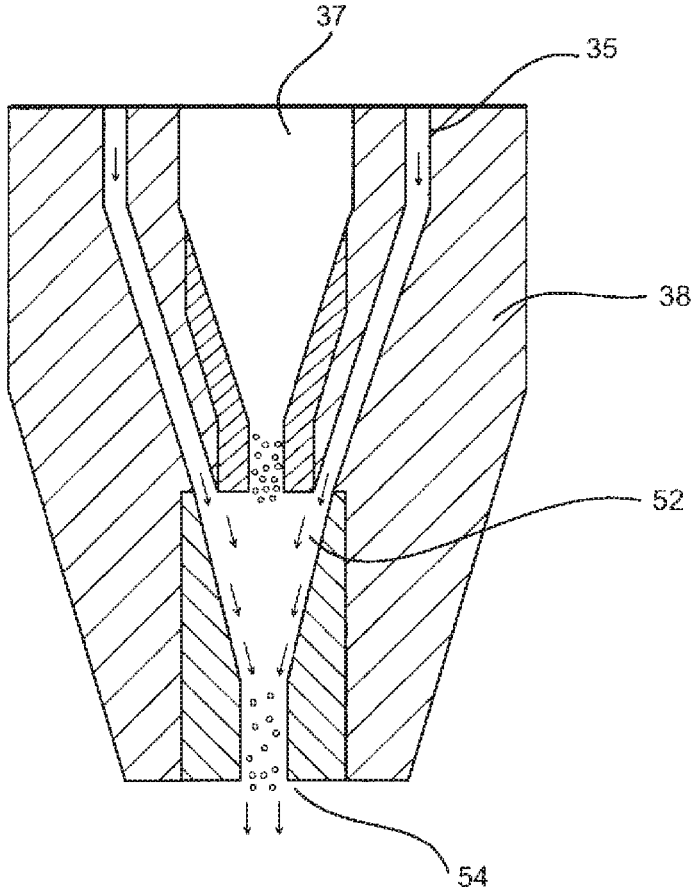
Fig 3b Prior Art
FIG. 3*b* is a cross sectional view of the prior art cutting nozzle of FIG. 3*a;*
Figure 4:
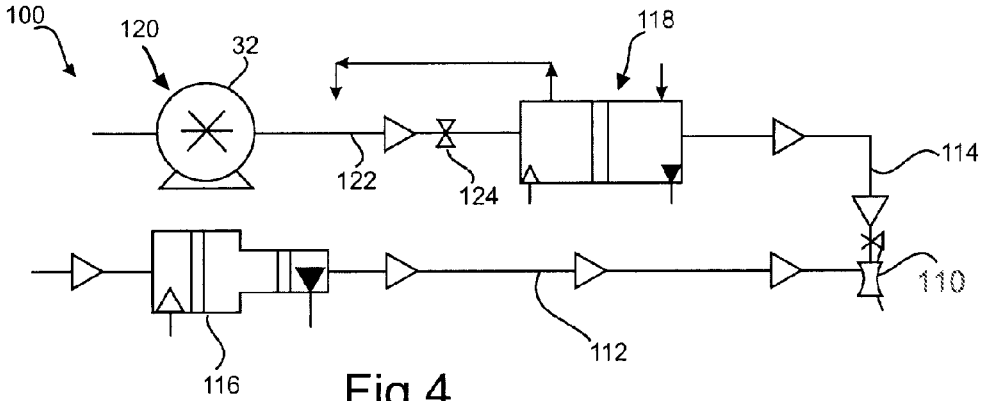
FIG. 4 is a schematic view of the high pressure cutting arrangement of the present invention.
Figure 5:
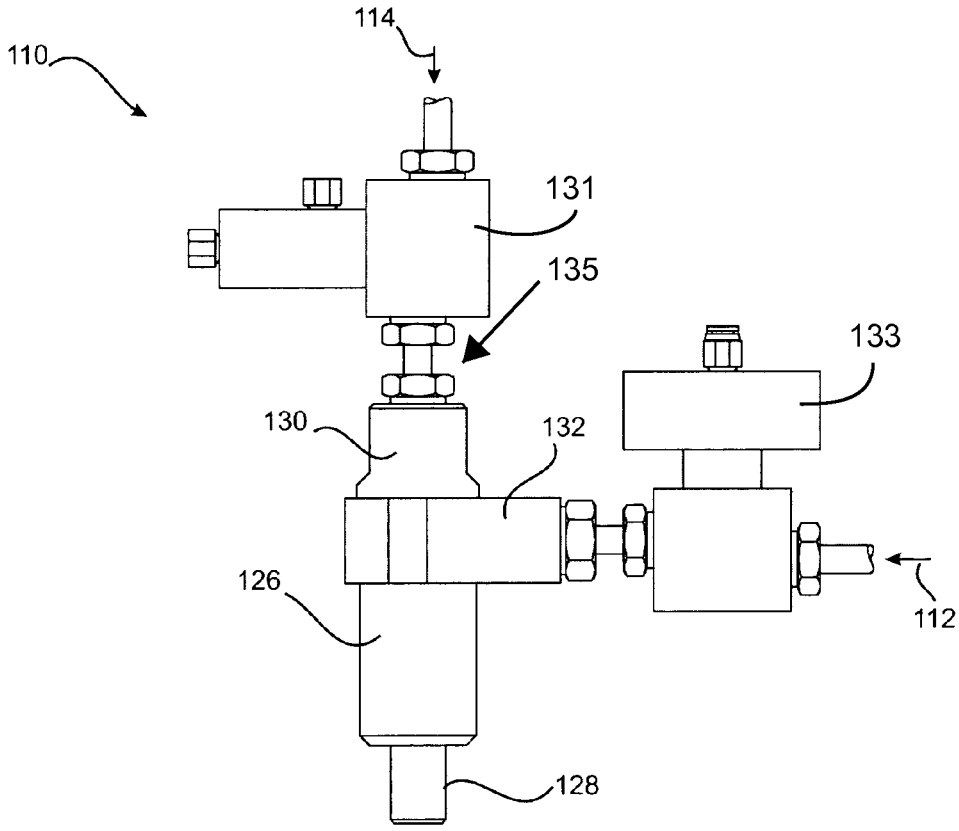
FIG. 5 is a cutting tool from within the cutting arrangement of FIG. 4.

FIG. 4 shows a schematic arrangement of a high pressure cutting system 100. The cutting system 100 has a cutting tool 110, to which is attached two input lines: a fluid or water flow stream 112 and a slurry flow stream 114. Each of the water flow stream 112 and the slurry flow stream 114 are supplied to the cutting tool 110 under pressure.

Pressure is applied to the water flow stream 112 by a first energising means, being a constant pressure pump 116. In this embodiment, the constant pressure pump 116 is an intensifier type pump. The constant pressure pump 116 ensures that pressure in the water flow stream 112 is maintained at a constant, desired pressure. The desired pressure may be altered by control of the constant pressure pump 116. A typical available pressure range may be 150 MPa to 600 MPa. In typical operation, water pressure of about 300 MPa will provide a useful result.

Pressure is applied to the slurry flow stream 114 by a second energising means. The second energising means comprises a floating piston 118 which is powered by a constant flow water pump 120. In this embodiment, the constant flow water pump 120 is a multiplex pump. The floating piston 118 pushes a suspension of abrasive particles in water along the slurry flow stream 114, at a high density and low flow rate. The flow rate of the slurry stream 114 is governed by the flow rate of water 122 being pumped by the constant flow water pump 120. The desired flow rate of slurry may be altered by control of the constant flow pump 120. A typical flow rate of slurry is about one litre per minute.

The second energising means includes a valve 124 located along the water flow 122 between the constant flow pump 120 and the floating piston 118. Closure of the valve 124 redirects the water flow 122 away from the floating piston 118, and back to the constant flow pump 120. Closure of the valve 124 thus immediately ceases the supply of pressure to slurry stream 114. The valve 124 also prevents the backflow of water from the floating piston 118 to the constant flow pump 120, and thus hydraulically locks the floating piston 118, thereby also preventing the backflow of slurry from the slurry stream 114.

The cutting tool 110 includes a substantially cylindrical body portion 126 having a substantially cylindrical nozzle 128 extending from an outer end thereof. An inner end of the body portion 126 is connected to two injectors: an axial slurry injector 130 and an annular water injector 132. The injectors are arranged such that the water stream and the slurry stream both enter the body portion 126 in an axial direction, with the water stream being annularly positioned around the slurry stream. The water injector 132 includes flow straighteners to substantially remove turbulence from the water flow before entry into the body portion 126. In the embodiment of the drawings, water flow enters the water injector 132 in a radial direction and is then redirected axially. The flow straighteners, being a plurality of small tubes, assist in removing the turbulence created by this redirection.

The cutting tool 110 includes a slurry valve 131 located upstream of the slurry injector 130, and a water valve 133 located upstream of the water injector 132. The slurry valve 131 and the water valve 133 are each independently operable, and can be open or shut to permit or prevent flow.

An axial connection 135 between the slurry valve 131 and the slurry injector 130 is of variable length.

Figure 6:
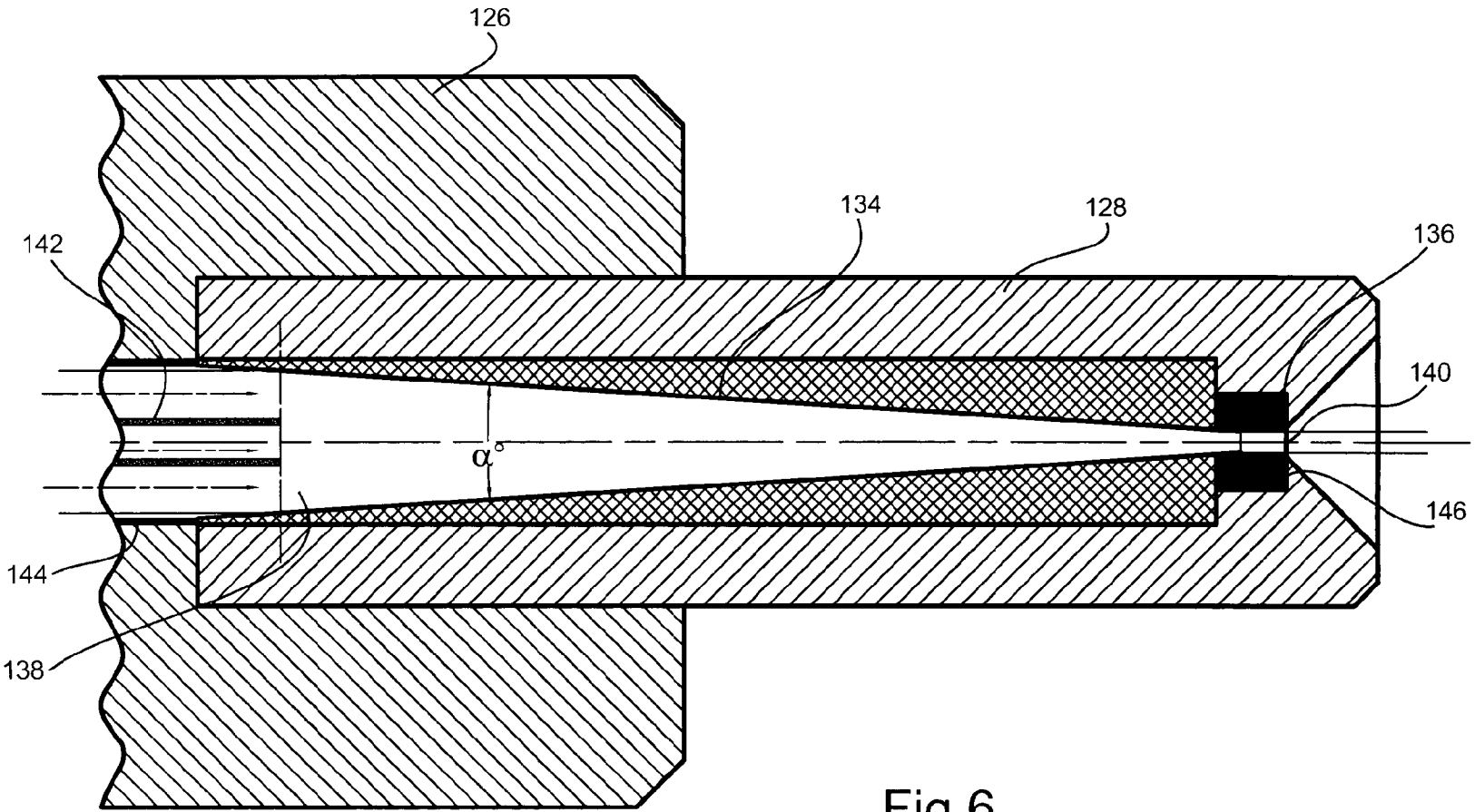
FIG. 6 is a cross sectional view of a portion of the cutting tool of FIG. 5, including a nozzle.

The nozzle 128 can be best seen in FIG. 6. The nozzle includes a combining chamber 134 and a focussing region 136. The combining chamber includes an entry region 138. The combining chamber 134 is also a conical accelerating chamber, with a cone angle of about 13.5°.

The focussing region 136 is a constant-diameter portion of the nozzle immediately adjacent a nozzle outlet 140. The focussing region has a length:diameter ratio of at least 5:1, and preferably greater than 10:1.

The entry region 138 is arranged to receive slurry flow through an axially inlet tube 142 of substantially constant diameter. The entry region is also arranged to receive water through an axially aligned annulus 144 about the inlet tube 142. The annulus 144 has an outer diameter about three to four times the diameter of the inlet tube 142. The annulus 144 joins the inner wall of the combining chamber 134 in a continuous fashion, thus reducing any propensity for the introduction of turbulence into the water flow.

The position of the entry tube 142, and hence the entry region 138, is variable. The position can be varied by adjustment of the axial connection 135. The axial positioning of the entry region 138 allow for the water flowing through the annulus 144 to be accelerated to a desired velocity before it enters the entry region 138. This allows for the calibration of the flows of water and slurry, and may allow an operator to adjust for wear or loss of power.

Figure 7:
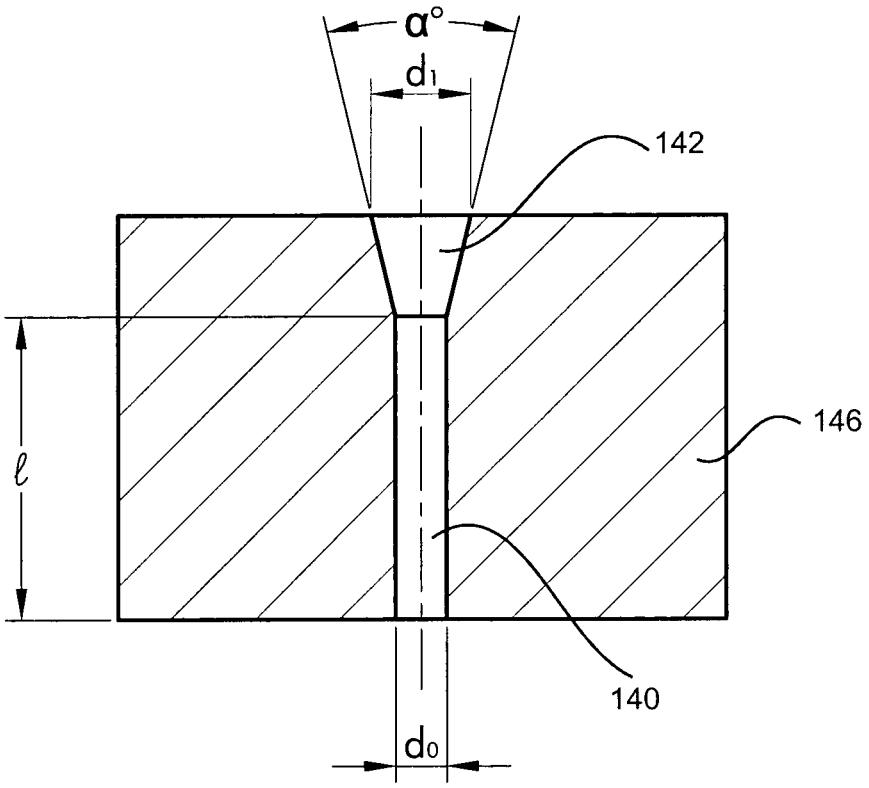
FIG. 7 is a cross sectional view of a focussing nozzle within the cutting tool of FIG. 5.

In the embodiment of the drawings the focussing region 136 is formed within a separate focussing nozzle 146 which is axially connected to the combining chamber 134. The focussing nozzle 146, as shown in FIG. 7, includes an accelerating region 148 immediately prior to the focussing region 136. The accelerating region 148 has a cone angle greater than or equal to that of the combining chamber 134. The accelerating region 148 has a diameter at inlet substantially identical to the diameter at an outlet of the combining chamber 134. It is considered desirable that the inlet diameter of the accelerating region 148 be not significantly greater than the outlet diameter of the combining chamber 134 in order to reduce any propensity for the introduction of turbulence.

The focussing nozzle 146 may be formed of a harder, more abrasive resistant material than that of the combining chamber 134. As such, the respective portions of the nozzle 128 may be designed such that the fluid/abrasive stream is accelerated to a first velocity, for instance 250 m/sec, in the combining chamber, and then accelerated to its final velocity in the accelerating region 148. The respective velocities can be designed and selected in accordance with the abrasive resistance of the materials used in the two portions.

Figure 8:
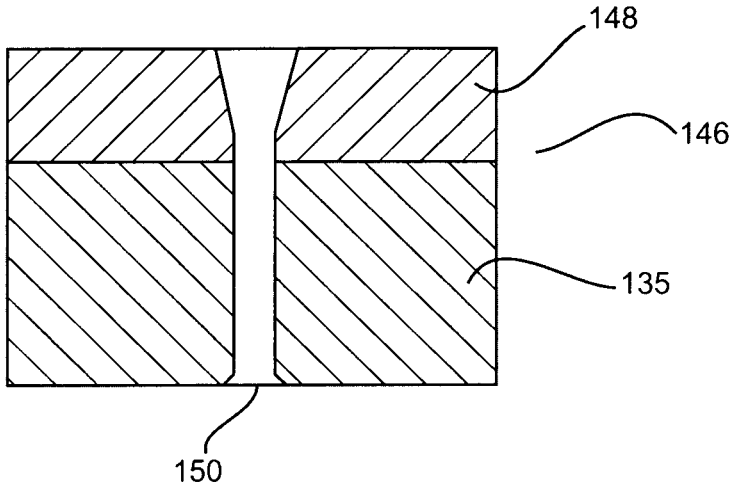
FIG. 8 is a cross sectional view of an alternative embodiment of a focussing nozzle for use within the cutting tool of FIG. 5.

In an alternative embodiment, as shown in FIG. 8, the focussing nozzle 146 is a compound nozzle, with the accelerating region 148 formed from a particularly hard, abrasive resistant material such as diamond and the focussing region 135 formed from another suitable material such as a ceramic material. In this embodiment the diameter of the focussing region 136 is designed to be equal to or slightly smaller than the minimum (exit) diameter of the accelerating region 148.

In both embodiments the nozzle 128 is of sufficient length to allow the required velocity of a water/slurry mix to be met, typically up to 600 m/sec. It will be noted that, in the embodiment of the drawing, this requires the diameter of the focussing region 136 to be less than that of the slurry inlet tube 142.

The nozzle includes a chamfered exit 150 at the outlet 140. The cone angle of the chamfer is sufficient to ensure separation of flow at the exit 150. In the embodiment of the drawings, this angle is 45°.

Figure 9:
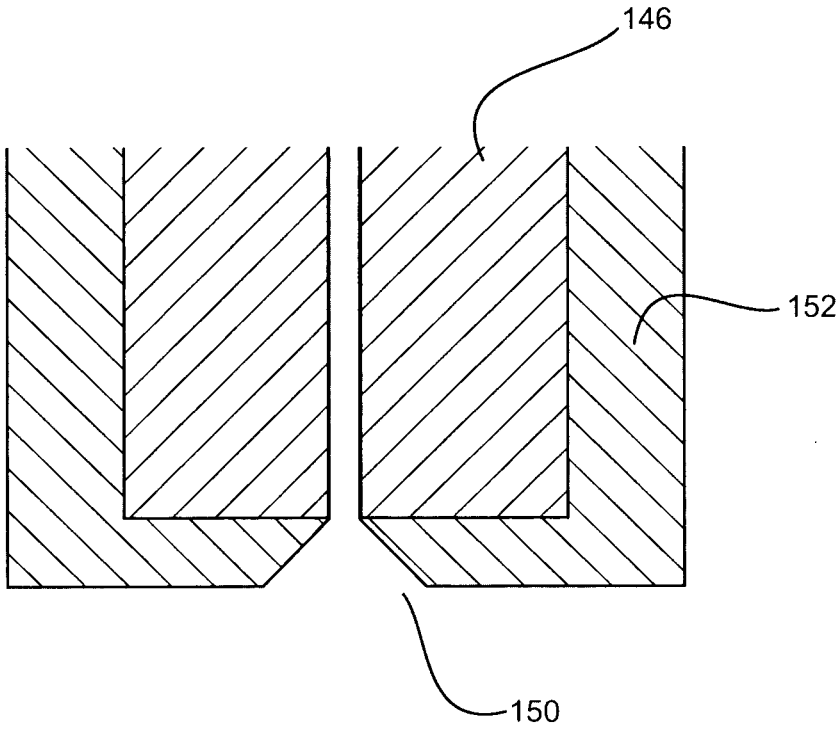
FIG. 9 is an alternative embodiment of a cutting tool for use within the cutting arrangement of FIG. 4.

In a further alternative embodiment, as shown in FIG. 9, the focussing nozzle 146 is contained within an external holder 152. The chamfered exit 150 in this embodiment is formed within the external holder 152.

In use, water is pressurised to the required pressure (such as 300 MPa) by the constant pressure pump 116. It is pumped under this pressure to the cutting tool 110, through the annular water injector 126, and then into the annulus 144. From the annulus it enters the entry region 138, and establishes a pressure in the entry region 138 close to the pressure at which it was pumped.

Slurry, energised by the floating piston 118, is pumped along to the cutting tool 110, through the slurry injector 130 into the inlet tube 142.

It will be appreciated that slurry will only proceed into the entry region 138 when pressure in the inlet tube 142 exceeds the pressure in the entry region 138. When slurry is flowing, the action of the floating piston 118 (powered by the constant flow pump 120) acts to increase pressure in the slurry flow stream until it is sufficiently high to enter the entry region 138 of the combining chamber 134. It will be appreciated that this is marginally higher than the pressure created in the entry region 138 by the water flow. When this pressure, (which is generally also about 300 MPa) is established in the slurry stream, the action of the pump 120 will result in slurry being continuous supplied to the chamber 134 at a constant rate and pressure.

Water and slurry will be rapidly advanced and mixed along the chamber 134. The annular water flow will largely protect the walls of the chamber 134 from the abrasive action of the slurry, at least at the inner part of the nozzle 128.

By the time the flow has been accelerated to the focussing nozzle 146, the water and slurry will be well mixed. At least a portion of the focussing nozzle must therefore be constructed from an abrasion-resistant material, such as diamond.

The flow will exit the focussing nozzle 146 through the outlet 140 at an extremely high velocity, suitable for cutting many metals and other materials.

When cutting is to be stopped, the valve 124 is activated to immediately cease operation of the floating piston 118. It will be appreciate that the valve 124 is only acting against water, not abrasive material, and therefore is not subject to extreme wear.

The ceasing of the floating piston 118 will cause energy to stop being added to the slurry stream 114. This will result in pressure dropping in the slurry stream 114 and the inlet tube 142.

As soon as pressure in the inlet tube 142 drops marginally below the water pressure in the entry region 138, the water pressure will prevent the flow of slurry into the entry region 138. It will be appreciated that this occurs virtually instantaneously on activation of the valve 124. The output jet will change from being a water/slurry jet to being a water only jet.

At this point the slurry stream 114 will be maintained under high pressure, zero velocity conditions. In these conditions the slurry valve 131 can be closed without subjecting the valve 131 to excessive wear.

Once the slurry valve 131 has been closed, the water valve 133 can be closed in order to cease the flow of water. This sequence of valve closures can be controlled rapidly, thus providing a convenient means to start and stop cutting at the cutting head 110.

When cutting is to be recommenced, the valve control sequence can be implemented in revers, with water valve 133 being opened first, followed by slurry valve 131. Subsequent opening of the valve 124 will result in a virtually instantaneous reestablishment of the slurry flow into the combining chamber 134.

The nozzle includes a chamfered exit 150 at the outlet 140. The cone angle of the chamfer is sufficient to ensure separation of flow at the exit 150. In the embodiment of the drawings, this angle is 45°.

In a further alternative embodiment, as shown in FIG. 9, the focussing nozzle 146 is contained within an external holder 152. The chamfered exit 150 in this embodiment is formed within the external holder 152.

Modifications and variations as would be apparent to a skilled addressee are deemed to be within the scope of the present invention.

The invention claimed is:

1. A cutting tool for a high pressure cutting arrangement, the cutting arrangement comprising a liquid stream and a slurry stream, the slurry comprising abrasive particles suspended in a fluid, the cutting tool including a combining and mixing chamber, the combining and mixing chamber having an entry region arranged to receive the liquid stream and the slurry stream, the slurry stream and the liquid stream being arranged to enter a nozzle, wherein the nozzle is an accelerating nozzle with an outlet smaller in diameter than the entry region, and wherein the outlet is smaller in diameter than a diameter of the slurry stream on entry into the nozzle, and wherein the pressure in the entry region is determined by the pressure in the liquid stream, and the pressure in the entry region acts on the pressure in the slurry stream to regulate the pressure in the slurry stream.

2. A cutting tool as claimed in claim 1, wherein the cutting tool includes a slurry valve which can selectively permit or prevent the flow of slurry into the combining and mixing chamber, and a fluid valve which can selectively permit or prevent the flow of liquid into the combining and mixing chamber.

3. A cutting tool as claimed in claim 1, wherein the nozzle is elongate and the slurry stream and the liquid stream being oriented in the elongate direction.

4. A cutting tool as claimed in claim 3, wherein the nozzle has a central axis, with the slurry stream being oriented along the central axis and the liquid stream being provided in an annulus about the slurry stream.

5. A nozzle for a high pressure cutting arrangement, the cutting arrangement comprising a liquid stream and a slurry stream, the slurry comprising abrasive particles suspended in a fluid, the nozzle including a combining and mixing chamber, the combining and mixing chamber having an entry region arranged to receive the liquid stream and the slurry stream, wherein the nozzle is an accelerating nozzle with an outlet smaller in diameter than the entry region, and wherein the outlet is smaller in diameter than a diameter of the slurry stream on entry into the nozzle, and wherein the pressure in the entry region is determined by the pressure in the liquid stream, and the pressure in the entry region acts on the pressure in the slurry stream to regulate the pressure in the slurry stream.

6. A nozzle as claimed in claim 5, wherein the nozzle is elongate, and the slurry stream and the liquid stream are oriented in the elongate direction.

7. A nozzle as claimed in claim 5, wherein the nozzle has a central axis, with the slurry stream being oriented along the central axis and the liquid stream being provided in an anulus about the slurry stream.

8. A nozzle as claimed in claim 5, wherein the nozzle has a constant diameter focussing portion at an outer end thereof, and a conical accelerating portion of reducing diameter between the entry region and the focussing portion.

9. A nozzle as claimed in claim 8, wherein the cone angle is less than 27°.

10. A nozzle as claimed in claim 9, wherein the cone angle is about 13.5°.

11. A nozzle as claimed in claim 8, wherein the focussing portion of the nozzle has a length:diameter ratio greater than 5:1.

12. A nozzle as claimed in claim 11, wherein the focussing portion of the nozzle has a length:diameter ratio greater than 10:1.

13. A nozzle as claimed in claim 8, wherein the focussing portion of the nozzle has a length:diameter ratio less than about 30:1.

14. A nozzle as claimed in claim 8, wherein the nozzle is a two-part nozzle, with the combining and mixing chamber defining a first part and the focussing portion contained within a second part.

15. A nozzle as claimed in claim 14, wherein the second part is a focussing nozzle, and includes an accelerating portion with cone angle greater than or equal to that of the combining and mixing chamber.

16. A nozzle as claimed in claim 15, wherein the focussing portion has a diameter equal to or slightly smaller than the smallest diameter of the accelerating portion.

17. A nozzle as claimed in claim 15, wherein the accelerating portion of the focussing nozzle is constructed from an abrasive resistant material such as diamond.

18. A nozzle as claimed in claim 15, wherein the focussing nozzle has an outlet including an exit chamfer having a cone angle of about 45°.

19. A nozzle for a high pressure cutting arrangement, the cutting arrangement comprising a liquid stream and a slurry stream, the slurry comprising abrasive particles suspended in a fluid, the nozzle including a combining and mixing chamber, the combining and mixing chamber having an entry region arranged to receive the liquid stream and the slurry stream, wherein the nozzle is an accelerating nozzle with an outlet smaller in diameter than the entry region, and wherein the outlet is smaller in diameter than a diameter of the slurry stream at entry to the combining and mixing chamber, and wherein the pressure in the entry region is determined by the pressure in the liquid stream, and the pressure in the entry region acts on the pressure in the slurry stream to regulate the pressure in the slurry stream.

20. A nozzle as claimed in claim 5, wherein there is no additional accelerating nozzle along the slurry stream.

21. A cutting tool as claimed in claim 1, wherein pressure in the entry region acts on the pressure in the slurry stream in such a way that the slurry stream is prevented from entering the combining chamber unless the pressure in the slurry is marginally higher than the pressure at the combining chamber entry point.

* * * * *